United States Patent [19]

Yagi

[11] Patent Number: 4,870,930

[45] Date of Patent: Oct. 3, 1989

[54] ENGINE VALVE CONTROL APPARATUS

[75] Inventor: Toru Yagi, Musashino, Japan

[73] Assignee: Honda Giken Kogyo Kabushiki Kaisha, Tokyo, Japan

[21] Appl. No.: 196,713

[22] Filed: May 20, 1988

[30] Foreign Application Priority Data

May 22, 1987 [JP] Japan ..... 62-123647

[51] Int. Cl.[4] ..... F01L 1/04; F01L 9/04

[52] U.S. Cl. ..... 123/90.11; 123/90.15

[58] Field of Search ..... 123/90.11, 90.15, 90.16, 123/90.67, 320, 90.22

[56] References Cited

U.S. PATENT DOCUMENTS

| | | | |
|---|---|---|---|
| 3,525,317 | 8/1970 | Muir | 123/320 |
| 3,884,199 | 5/1975 | Irimajiri et al. | 123/90.22 |
| 4,697,558 | 10/1987 | Meneely | 123/321 |
| 4,762,095 | 8/1988 | Mezger et al. | 123/90.11 |

FOREIGN PATENT DOCUMENTS

| | | | |
|---|---|---|---|
| 0101206 | 6/1983 | Japan | 123/90.15 |
| 59-52111 | 4/1984 | Japan . | |

*Primary Examiner*—Charles J. Myhre
*Assistant Examiner*—Weilun Lo
*Attorney, Agent, or Firm*—Armstrong, Nikaido, Marmelstein, Kubovcik & Murray

[57] ABSTRACT

Control apparatus for an intake valve and/or an exhaust valve which are slidably mounted for reciprocating movement relative to a valve seat in a cylinder head including an electromagnetic solenoid fixed to the cylinder head and a magnetic pole fixed to at least one of the valves with the magnetic pole opposing the solenoid with a small gap therebetween when the valve(s) is in the open position and a control device for supplying electric current to the electromagnetic solenoid in a predetermined manner responsive to engine operation conditions. The valve(s) is moved to the open position by a cam, electric current is supplied to the electromagnetic solenoid to hold the valve(s) in the open position for a predetermined time and the valve(s) is closed by a return spring when the electromagnetic solenoid is de-energized.

5 Claims, 2 Drawing Sheets

ENGINE VALVE CONTROL APPARATUS

BACKGROUND OF THE INVENTION

This invention relates to an engine valve control apparatus which is mainly for use in an internal combustion engine of a vehicle, and in which at least one of an intake valve or an exhaust valve, both of which are operated by a cam and a return spring, is provided with an electromagnetic actuator which operates the valve in accordance with the state of operation of the engine.

A conventional valve control apparatus is known, for example, as disclosed in Japanese Utility Model Laid-Open No. 52111/1984 wherein the intake and exhaust valves are opened and closed by a cam and a return spring actuated by an electromagnetic actuator in accordance with the operating condition of an engine, to adjust the timing thereof to thereby obtain improved charging efficiency or predetermined combustion characteristics, such as: the desired output characteristics, fuel consumption, and exhaust gas characteristics.

However, the attraction force of an electromagnetic actuator, by virtue of its electromagnetic solenoid, decreases in proportion to the square of the distance between the electromagnetic solenoid and a magnetic pole member which is attracted by the electromagnetic solenoid. Therefore, in order to assure the attraction force required to open and/or close the intake or exhaust valve, the lift or extent of movement of each valve must be made small. This, however, causes problems in attempting to obtain predetermined combustion characteristics. Therefore, in the foregoing prior art control apparatus, it was necessary to increase the attraction force to provide a greater magnitude of lift, which required the use of an electromagnetic solenoid and power source of greater capacity. This resulted in disadvantageous and undesirable increases in the amount of space required and costs associated with the apparatus. These problems are avoided by the present invention.

SUMMARY OF THE INVENTION

According to the present invention an engine valve control apparatus is provided in which the attraction force of an electromagnetic solenoid is activated when the intake or exhaust valve is at the open position and a magnetic pole member on the valve is closest to the electromagnetic solenoid to hold the valve open and thus delay the closing operation. This enables supercharging action to take place so that an improvement in the output and other desired combustion characteristics of the engine can be obtained.

The engine valve control apparatus of the present invention is useful in an internal combustion engine wherein an engine intake valve and an exhaust valve are operated by a cam and a return spring. An electromagnetic actuator is provided which includes an electromagnetic solenoid fixed to the cylinder head and a magnetic pole member fixed to one of the valves. The magnetic pole member opposes the electromagnetic solenoid with a slight gap therebetween when the valve is in the open position. The valve is opened by the cam and held in the open position by the electromagnetic actuator until it is closed by the return spring when the electromagnetic actuator is deenergized.

The intake and exhaust valves are opened by the cam action of a rotatable cam. When the valves are opened, current is supplied to the electromagnetic actuator to hold the valves in the open position. The electric current supply to the electromagnetic actuator is stopped at a predetermined time and the valves are closed by a return spring. With his arrangement, the valve closing operation can be delayed to provide a supercharging effect according to the engine operating conditions.

Furthermore, in the valve control apparatus of the present invention, since the intake and exhaust valves are opened by a cam and the attraction force of the electromagnetic solenoid is activated with the valves in the open position where the electromagnetic solenoid and the magnetic pole member are closest to each other, there is no need to provide the additional attraction force which would be required to open the valves, and all that is necessary is sufficient attraction force to hold the valves at their open position. This also makes it possible to use the maximum level of the attraction force since the electromagnetic pole and solenoid are closest when the valves are in the open position. All these factors combine to avoid the necessity of using a large-capacity electromagnetic solenoid and power source.

The foregoing features and benefits of the invention will become apparent from the following description of the preferred embodiment taken in conjunction with the accompanying drawings.

DESCRIPTION OF THE PREFERRED EMBODIMENT

The present invention will now be described with reference to an intake valve of an internal combustion engine for a vehicle as shown by the accompanying drawings.

Figure 1:
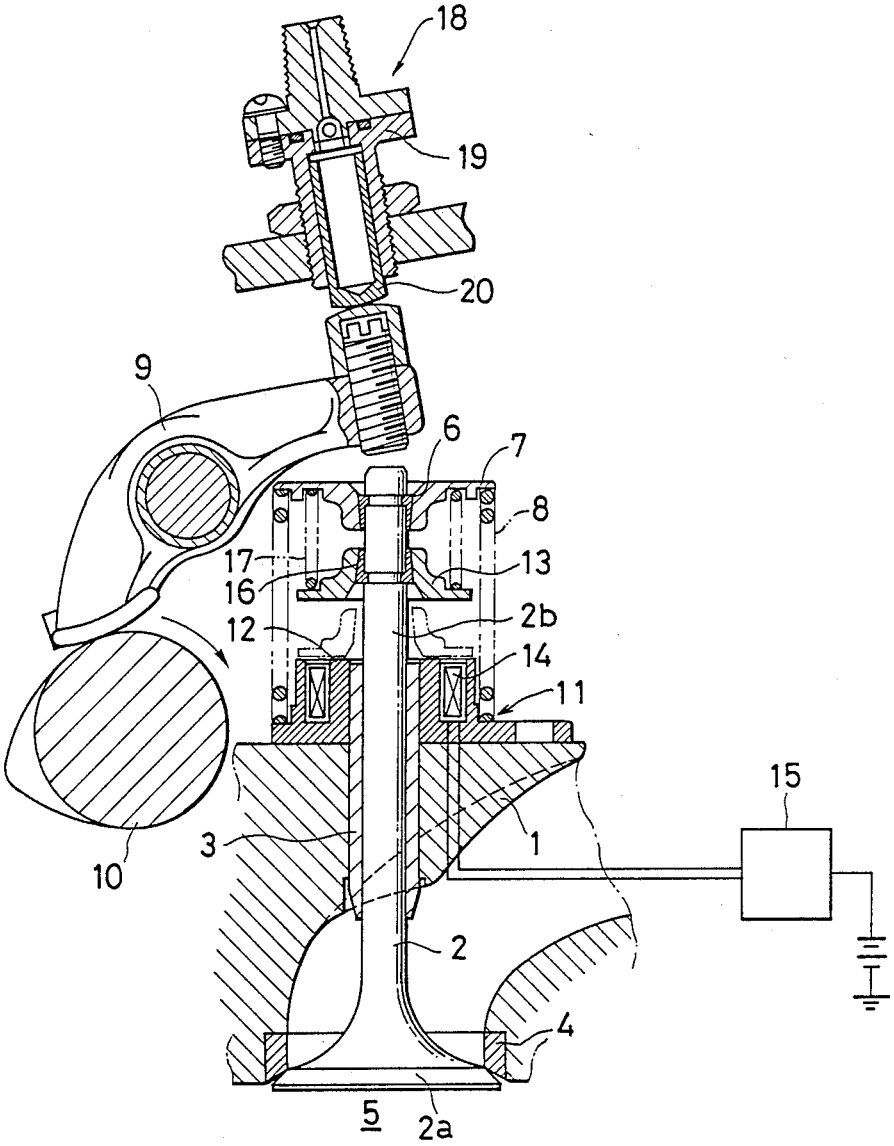
FIG. 1 is a cross-sectional, side elevational view of an embodiment of the present invention.

In FIG. 1, reference numeral 1 represents a cylinder head of an engine. The cylinder head 1 is provided with an intake valve 2 comprising a valve body **2*a* and a valve stem 2*b*. The valve stem 2*b* is slidably mounted and guided in the cylinder head 1 by a valve guide 3 provided in a bore through the cylinder head 1, so that the valve body 2*a* may be moved to and from a closed position in contact with a valve seat 4 provided at the combustion chamber side 5 of the cylinder head 1 as shown by FIG. 1. An end of the valve stem 2*b* is fitted with a retainer 7 by a valve collar 6 seated in a groove in the valve stem. A return spring 8 is provided between the retainer 7 and the cylinder head 1 to bias the intake valve 2 to the closed position as shown. The intake valve 2 is moved forward in the guide 3 away from the valve seat 4 to an open position by a rocker arm 9 which operates against the bias of return spring 8. The rocker arm 9, which swings to contact the top end of the valve stem 2*b* to open the valve, is moved by a lobe on cam 10** which is linked for synchronous rotation with the engine.

An electromagnetic actuator 11 is provided between the retainer 7 and the cylinder head 1. The electromagnetic actuator 11 is comprised of an electromagnetic solenoid 12 secured to the cylinder head 1 and a magnetic pole member 13 secured to the valve stem **2*b*. The magnetic pole member 13 is located to be positioned opposite to the solenoid 12 as shown by dot-dash lines in FIG. 1 when the valve is moved to the open position so as to be attracted to the solenoid 12. The electromagnetic solenoid 12 is formed in an annular shape and the valve stem 2***b* extends through the central portion thereof internally of the valve guide 3. An annular coil 14 which operates to attract the magnetic pole member 13 is disposed internally of the solenoid 12.

An electromagnetic force is generated to attract the magnetic pole member 13 to the solenoid 12 when the valve 2 is in the open position and electric current is supplied to the coil 14. Electric current is supplied to the coil 14 in a predetermined manner by a control unit 15 which operates in response to operating conditions of the engine as detected by the control unit 15 and/or sensors associated therewith.

The magnetic pole member 13 is also formed in an annular shape and the valve stem 2*b* extends through the central portion thereof. In order for the magnetic pole member 13 and the electromagnetic solenoid 12 to face each other with a slight, parallel gap therebetween when the intake valve 2 is at its open position, the pole member is fitted with a collar 16 of similar structure to the valve collar 6, but faces in the direction toward the solenoid 12. The collar 16 is interposed between the magnetic pole member 13 and the valve stem 2*b*. Thus, when the electromagnetic solenoid 12 is energized to generate an attraction force, the attraction force is applied to the intake valve 2 to hold the valve at its open position. Furthermore, there is disposed between the magnetic pole member 13 and the retainer 7 a coil spring 17 which by compression absorbs any thrust or shock which may be produced by the magnetic pole member 13 when the intake valve 2 is biased to the closed position by the return spring 8.

A seating-shock absorbing device 18 is also provided for the intake valve 2. The seating-shock absorbing device 18 comprises a casing 19 and a piston 20. The top end of the valve stem 2*b* contacts the piston 20 of the shock absorbing device 18 through the rocker arm 9. A hydraulic pressure is introduced between the casing 19 and the piston 20 so that shock caused by rapid seating of the intake valve 2 when the electromagnetic actuator 11 is deenergized will be absorbed by the hydraulic pressure in casing 19.

Although the invention has been described with reference to an engine using a rocker arm type of valve actuating device, the invention is equally applicable to an engine using a valve lifter type of valve actuating device.

During operation of an engine provided with the above-described valve control apparatus, the intake valve 2 is moved forward of the valve seat 4 by the cam 10 to open the valve. When the intake valve 2 is moved to the open position, current is supplied to the electromagnetic actuator 11, in response to the operating condition of the engine, to hold the intake valve 2 at the open position irrespective of the rotation of the cam 10. This delays closing movement of the valve for a predetermined period of time in response to particular operating conditions of the engine. When the electromagnetic solenoid is deenergized the valve 2 is closed by the return spring 8.

Figure 2:
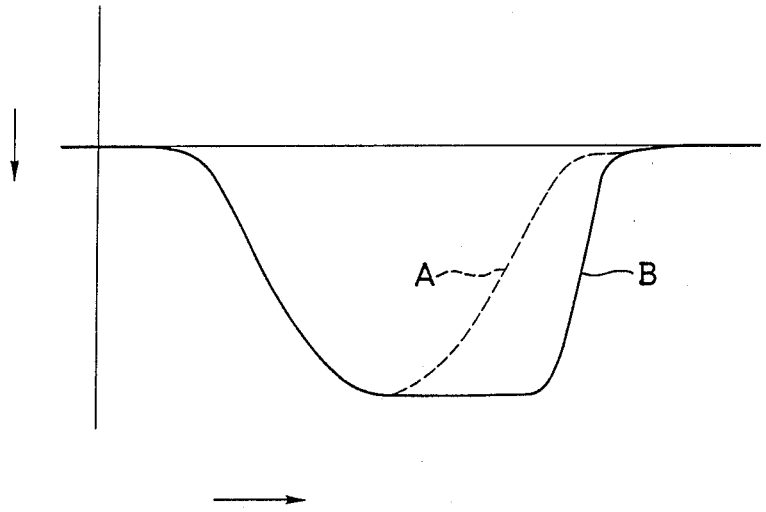
FIG. 2 is a diagram in the nature of a graph illustrating a comparison of a cam actuated valve controlled by apparatus of the present invention with a conventional cam actuated valve.

As shown in FIG. 2, the result of this sequence of operation provided by the valve control apparatus of the present invention is illustrated by a curve B in comparison with a curve A which represents the operation of a conventional intake valve which is opened and closed only by the cam and return spring. The additional period during which the intake valve 2 of the present invention is held in the open position thereby permitting the combustion chamber to be supercharged is shown by the area enclosed between the curves A and B.

The attraction force of the electromagnetic actuator 11 is sufficient if it can hold the intake valve 2 against the bias of the return spring 8 in the open position. Furthermore, since the magnetic pole member 13 is positioned very close to the electromagnetic solenoid 12 when intake valve is in the open position and the attraction force is to be applied to the magnetic pole 13, substantially all of the attraction force can be utilized due to the proximity of the pole 13 to the solenoid 12. This permits the use of electromagnetic solenoids and a power source of smaller capacity than the solenoid and power source which would be required if the solenoid were required to provide the force to open the valve in addition to holding the valve open. Consequently, the amount of space required and related costs can be reduced with the valve control apparatus of the present invention.

As described above, according to the present invention, the maximum attractive force of an electromagnetic actuator may be utilized by using the electromagnetic actuator only to hold the valve in the open position and, the charging efficiency and desirable combustion characteristics can be improved by the resulting delay in closing the valve. Consequently, the operation of the engine can be improved with the valve control apparatus of the present invention without sacrificing the additional space and costs which would be incurred with the use of larger electromagnetic actuators.

What is claimed is:

1. A valve control apparatus for an internal combustion engine wherein an intake valve and an exhaust valve are opened by valve-opening operation of a cam and closed by valve-closing operation of a return spring, at least one of said intake valve and exhaust valve being provided with a valve-holding means which is controlled according to operating conditions of the engine so that said at least one valve opened by said cam is held in its open position by said valve-holding means and closed by said return spring when said valve-holding means is released, said valve holding means comprising: an electromagnetic actuator including an electromagnetic solenoid fixed to a cylinder head of said engine adjacent said at least one valve; and a magnetic pole member fixed to said at least one valve and positioned to provide a small gap with said solenoid when said valve is in said open position, said magnetic pole member being held by said solenoid when said at least one valve is in said open position upon activation of said solenoid by control means.

2. A valve control apparatus for an internal combustion engine as claimed in claim 1, wherein said return spring is disposed between a retainer fixed to said one valve and a cylinder head of said engine, said magnetic pole member is formed in the same shape as said retainer and fixed to said one valve between said retainer and said electromagnetic solenoid by a collar and coil spring with said magnetic pole facing in the opposite direction with respect to the retainer.

3. A valve control apparatus for an internal combustion engine as claimed in claim 2, wherein said electromagnetic actuator has a center hole and said electromagnetic actuator is fixed to the cylinder head with a valve guide portion projecting above the cylinder head and fitting into the center hole of the actuator.

4. A valve control apparatus for an internal combustion engine as claimed in any one of claims 2, 3, or 1, wherein the valve-opening operation by said cam is carried out through a rocker arm.

5. A valve control apparatus for an internal combustion engine as claimed in any one of claims 2, 3, or 1, further including a shock absorber opposite one end of said one valve which absorbs shock that may be generated when said one valve is closed.

* * * * *